United States Patent [19]

Marocco

[11] Patent Number: 4,886,269

[45] Date of Patent: Dec. 12, 1989

[54] TABLE TENNIS PRACTICE AID

[76] Inventor: Claude C. A. Marocco, 172 Evans St., Rozelle, Australia, 2041

[21] Appl. No.: 177,387

[22] Filed: Apr. 4, 1988

Related U.S. Application Data

[63] Continuation of Ser. No. 1,658, Feb. 1, 1986, Pat. No. 4,735,405.

[51] Int. Cl.[4] ..... A63B 39/00

[52] U.S. Cl. ..... 273/30; 124/56; 124/60; 124/71

[58] Field of Search ..... 273/30, 29 A, 26 D; 124/56, 57, 59, 60, 71, 76, 41 R

[56] References Cited

U.S. PATENT DOCUMENTS

| | | | |
|---|---|---|---|
| 387,517 | 8/1918 | Jackson | 124/51 R |
| 1,873,677 | 8/1932 | Traver | 124/6 X |
| 2,508,461 | 5/1950 | Lemon | 273/30 |
| 2,765,717 | 10/1956 | Cook | 273/30 |
| 3,089,476 | 5/1963 | Wolverton | 124/51 A |
| 3,306,613 | 2/1967 | Mamers | 273/26 D |
| 3,989,245 | 11/1976 | Augustine et al. | 124/56 |
| 4,002,336 | 1/1977 | Beaver et al. | 273/30 |
| 4,116,438 | 9/1978 | Berliner | 124/51 R |
| 4,270,511 | 6/1981 | Ehama | 124/56 |
| 4,559,918 | 12/1985 | Ballerin et al. | 124/41 R |

FOREIGN PATENT DOCUMENTS

| | | | |
|---|---|---|---|
| 3405902 | 8/1985 | United Kingdom | 273/30 |

*Primary Examiner*—Edward M. Coven
*Assistant Examiner*—T. Brown
*Attorney, Agent, or Firm*—Fleit, Jacobson, Cohn, Price, Holman & Stern

[57] ABSTRACT

A table tennis training device comprises a frame (10) extending the width of the table and having a pliant screen (28) associated therewith to provide a back stop for table tennis balls. A wall (18) of L-shape cross-section is attached to and extends between frame (10), and has a series of alternate rises and falls in its base portion. A table tennis ball projecting device attached to frame (10) comprises a source of compressed air having first and second outlets. The first outlet is in operative communication with a first type ejector tube (42) having foot-operated means for regulating the entry of balls therein. The second outlet is in operative communication with a plurality of second type ejector tubes (66) extending through wall (18) and located to correspond to the gully formed between adjacent falls of the base portion. Each tube (66) can be variably angled relative to the table and is provided with a downwardly opening aperture in its peripheral wall disposed proximally above the corresponding base portion gully.

4 Claims, 3 Drawing Sheets

TABLE TENNIS PRACTICE AID

CROSS-REFERENCE TO RELATED APPLICATIONS

This U.S. application stems from PCT International Application No. PCT/AU85/00069 filed Apr. 04, 1985.

This is a continuation of application Ser. No. 001,658 filed Dec. 1, 1986, now U.S. Pat. No. 4,735,405.

TECHNICAL FIELD

The present invention relates to a training device especially for use with table tennis tables.

BACKGROUND ART

Practice aids are required by tennis players of all levels. Experienced players need regular practice to maintain and develop keen hand-eye coordination and to maintain a competitive level of play. Recreational players need practice and exercise on their own schedules when partners may not be available. Beginners need concentrated practice on the fundamentals of table tennis, to develop strokes and a game style suitable for more serious play.

One practice aid or training device for self-practicing table tennis, ping pong or like games is to hit the ball against a resilient back surface, such as one half of a foldable table which has been folded such that one half thereof is substantially perpendicular. This has a disadvantage in that, firstly not all tables can be folded in this manner and, secondly, it does not aid practice on the full length of the table in its normal horizontal position.

Practice aids or training devices for table tennis and the like are known including apparatus for projecting one or more balls towards the player. Some known devices have also incorporated means to facilitate recovery and recycling of balls which have fallen out of play. However, such devices have generally tended to be somewhat limited in that the angle of projection of the delivered balls cannot be readily varied during play and because a variety of strokes cannot be played or practiced to provide sufficient game practice.

In addition some practice aids have been relatively complex to manufacture and there is a need to provide a practice aid or training aid which is versatile in performance while being simple in concept and relatively low in manufacturing costs.

DISCLOSURE OF THE INVENTION

The present invention provides an apparatus that can be arranged to provide a variety of angled shots without between game adjustments and also a device that allows more than one ball in play if it is desired to quicken ones reflexes.

According to the present invention there is provided a table tennis practice device adapted to be attached to a table tennis table and to project table tennis balls across the table towards a user, the device comprising a source of compressed air, at least one ejector tube which can be variably angled relative to the table, the or each ejector tube being substantially straight and being operatively connected at one end to the source of compressed air, the or each ejector tube having intermediate its ends a downwardly opening aperture in its peripheral wall, the or each such aperture being disposed adjacent and above guide means adapted to guide table tennis balls towards the aperture or one of the apertures.

The source of compressed air may be of any type of compressor or universal motor-type device, such as a domestic vacuum cleaner, capable of producing a positive air flow.

Preferably the air flow from the compressor can be varied so as to be able to vary the velocity of a ball ejected from the ejector tubes. Such variation can be achieved by varying the diameter of the tubes or by applying choking means to the tubes.

The first type ejector tube is preferably of constant diameter and slightly greater than the diameter of a table tennis ball. Desirably the compressed air is blown axially into the tube at an end opposite to an ejection opening.

The means to regulate the entry of balls into the first type ejector tube is preferably contained in a magazine operatively connected to the ejector tube. The magazine is preferably tubular of constant diameter slightly greater than the diameter of a table tennis ball and is preferably located distal to an opening of the ejector tube. The magazine is designed to hold at least one ball, and preferably a plurality of balls, and is preferably disposed so that table tennis balls are gravity fed into the ejector tube.

A release mechanism is preferably located within the magazine so as to allow the sequential passage of balls into the ejector tube.

Preferably the release mechanism is a resiliently and pivotally mounted arm having a U-shaped end which projects through an aperture in the wall of the magazine. The aperture is preferably located adjacent to the lower end of the magazine.

The second type ejector tube is preferably of constant diameter and slightly greater than the diameter of a table tennis ball and may be variably angled relative to the table tennis table. Variation of the length of the ejector tube also helps to effect the speed and trajectory of the ball.

The aperture in the peripheral wall of the second type ejector tube is of sufficient size to allow a table tennis ball to pass therethrough into the ejector tube, and when air is blown through the tube from the compressor, a negative pressure or venturi effect is produced which facilitates the entry of the ball into the tube through the aperture.

In a most preferred embodiment of the invention the second outlet means is in operative communication with a manifold. The manifold is preferably tubular and of constant diameter and preferably four second type ejector tubes are in operative communication with the manifold. The ejector tubes are preferably equally spaced apart, and are normally disposed to the manifold, and are rotatable about and adjustably angled relative to the manifold so as to be able to vary the trajectory of the ball when ejected therefrom.

The wall means may be of any type and configuration but is preferably of L-shaped cross-section and has a series of alternate rises and fall in its base portion to facilitate direction of balls towards the apertures in the second type ejector tubes. Alternatively, trough-like gutter means may be provided to facilitate collection of balls and distribution to the nearest available ejector tube.

There is also provided a means for picking up table tennis balls comprising a tube of constant diameter having a resiliently constricted opening at one end. This end of the tube is forced over the balls which are received within the tube and prevented from falling out of the tube by the resiliently constricted end. The tube, when full, can be up ended and its contents poured into the magazine means.

BRIEF DESCRIPTION OF THE DRAWINGS

An embodiment of the present invention will now be described by way of example with reference to the drawings, in which.

MODE FOR CARRYING OUT THE INVENTION

Figure 1:
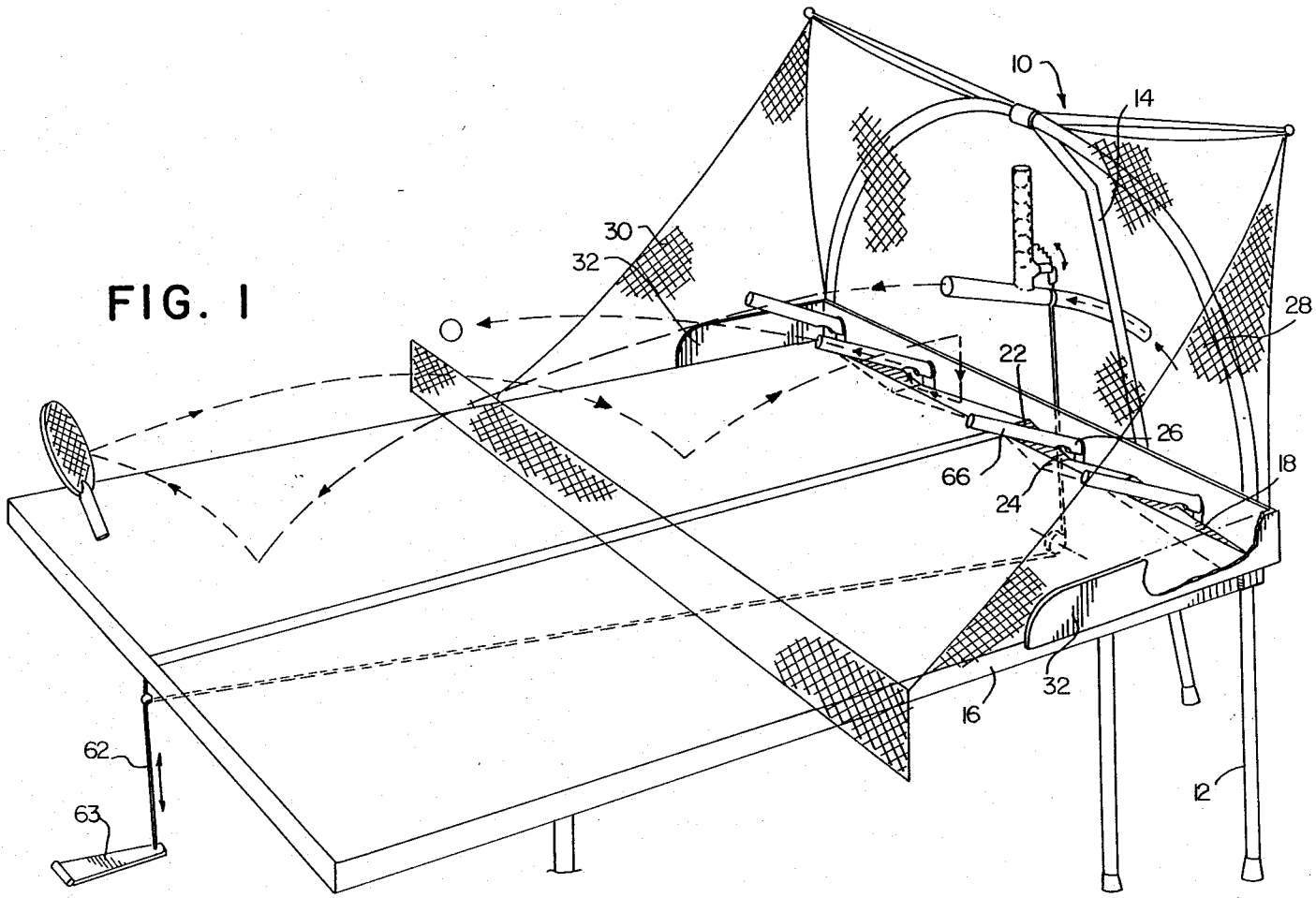
FIG. 1 is a perspective view of a training device of the present invention in use with a table tennis table.
Figure 2:
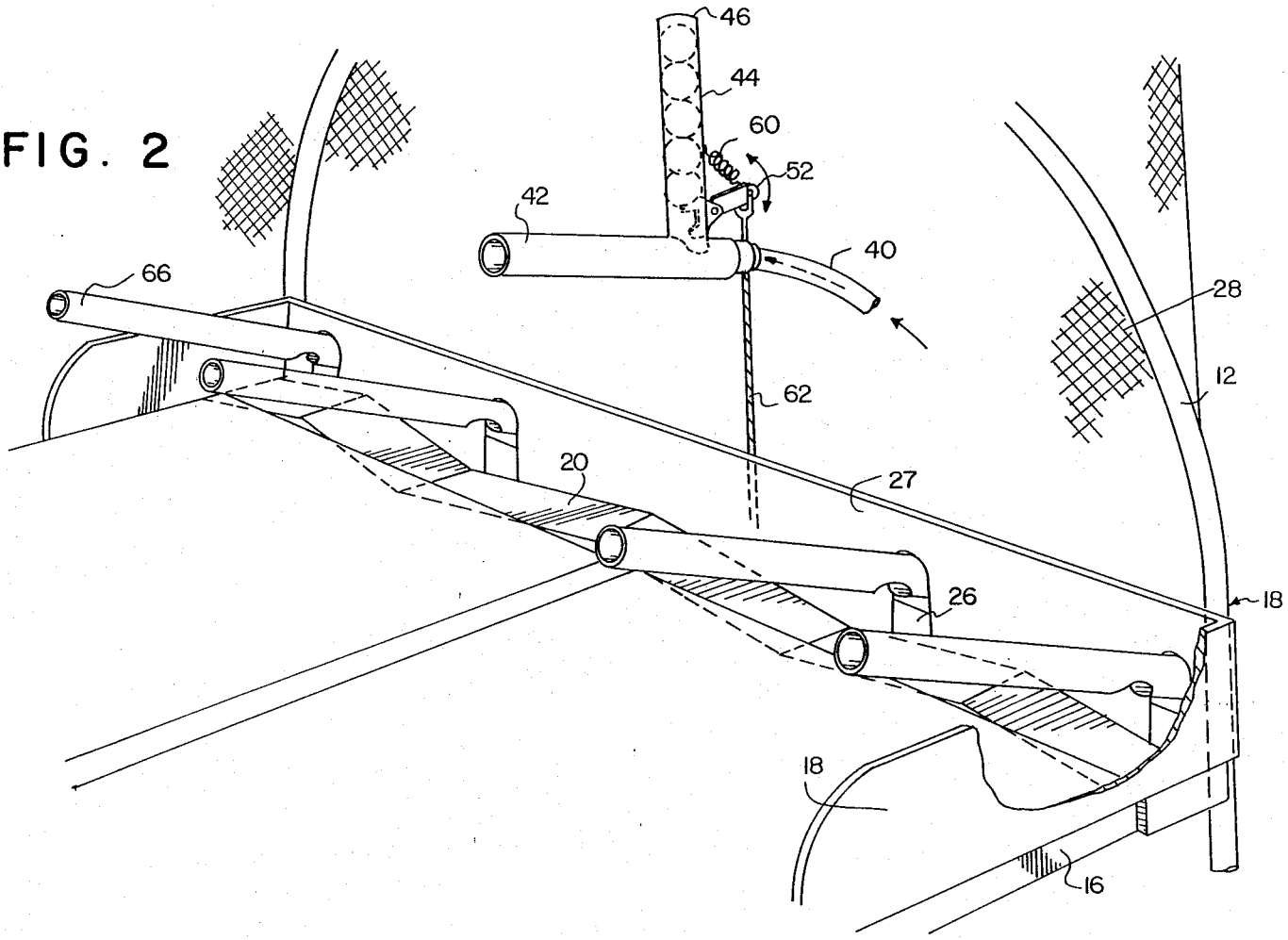
FIG. 2 is an enlarged perspective view of the training device of FIG. 1.
Figure 3:
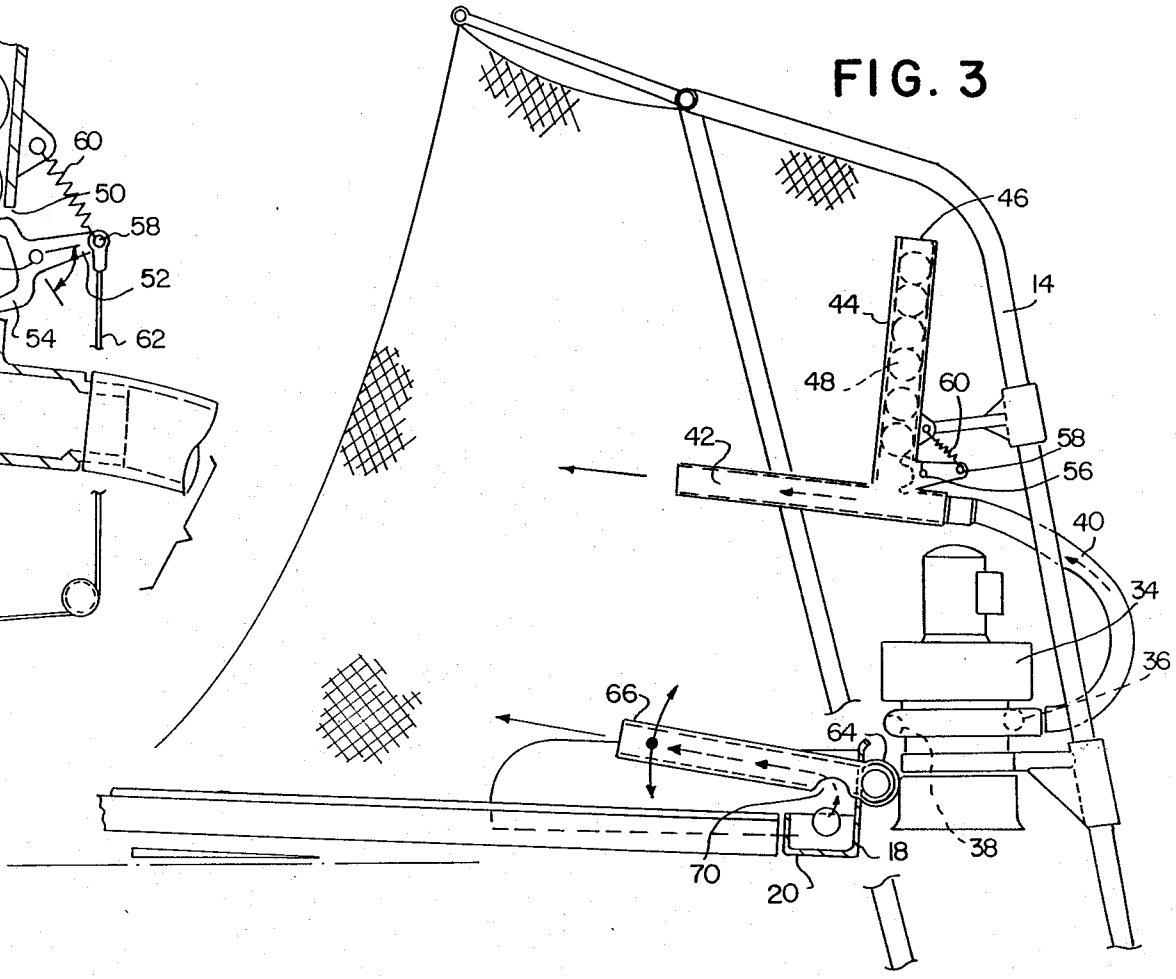
FIG. 3 is a side elevational view of the practice or training device according to the present invention.
Figure 4:
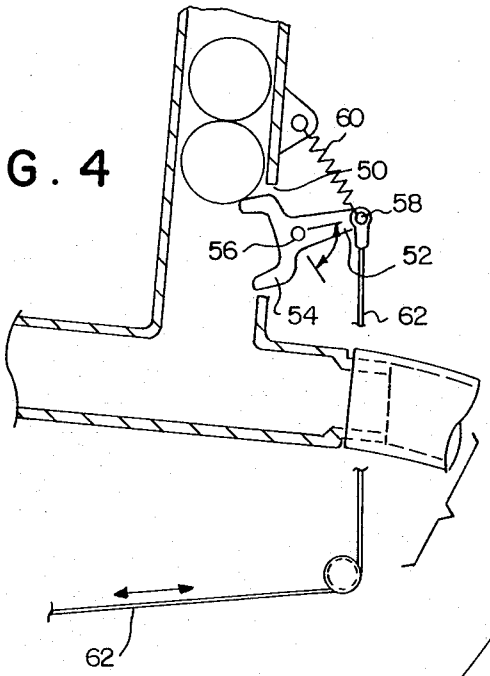
FIG. 4 is a sectional side elevational view of the release mechanism in the magazine.

The training device for use with a table tennis table as shown in FIGS. 1–3 comprises a frame 10 having an upstanding inverted parabolic member 12 and a downwardly extending rear leg member 14 attached to the top of the parabolic member 12. The frame is disposed in abutment to an end of the table tennis table 16 and extends the width of the table.

A wall 18 of substantially L-shape cross-section is attached to and extends between the parabolic member 12. A base portion 20 of the wall abuts the end of the table and comprises alternate rises and falls. Four apertures 26 penetrate a back portion 27 of the wall and located to correspond to the gully formed between adjacent falls of the base portion.

A pliant screen 28 extends across the parabolic member 12 to form a backscreen. The pliant screen 28 extends downwardly to the wall 18 and is supported to extend forwardly of the frame on either side of the table so as to produce an open faced enclosure 30.

A side panel 32 extends normally from either end of the wall contacting a longitudinal edge of the table tennis table to act as a deflector for balls which may bounce towards the side of the table.

A table tennis ball projecting device is located behind the screen 28 attached to rear leg 14 and includes a compressor 34 having a first outlet 36 and a second outlet 38. Outlet 36 is in communication with flexible conduit 40 which communicates at its other end with first type tubular ejector 42. Ejector 42 is of constant diameter, slightly greater than the diameter of a table tennis ball, and projects through and beyond the screen 28 towards the direction of the player.

A tubular magazine 44 is in communication at its bottom end to ejector 42 proximal to its fixed end. The magazine 44 is of constant diameter having an open top end 46 and holds a number of table tennis balls. Spaced apart apertures intermittently penetrate the peripheral wall throughout the length of the magazine for sighting the balls, and to regulate the suction forces inside the magazine.

An axial elongated aperture 50 extends through the lower end of the peripheral wall of the magazine 44 through which having a bight portion of a relase mechanism 52 having a U-shaped end 54 projects. The release mechanism 52 is pivotally mounted at 56 externally to the magazine and is attached at its other end 58 to an end of a spring 60. The spring 60 is attached at its other end to the magazine 44 above the aperture 50. The release mechanism 54 is connected by cable means 62 at its end 58 with a foot pedal 63 at the player end of the table tennis table.

Outlet 38 is in communication with a lateral tubular manifold 64, of constant diameter and disposed in a horizontal position. Four spaced apart ejector tubes 66 are each rotatably attached to, and in aperture communication at one end of each tube with, manifold 64.

Each ejector tube 66 has a downwardly opening aperture 70 in the wall located proximal to the manifold 64.

The ejection tubes 66 are located to extend through and beyond the apertures 26 in the wall 27 with the downwardly opening apertures 70 disposed proximally above the valley formed between adjacent downwardly-sloping sections of the base portion 20 of the wall.

In use the half portion of the table nearest the ejecting device slopes away from a player, as shown in FIG. 3, to facilitate the movement of balls toward the wall means.

The release mechanism 52 in the non-use position is disposed so that its U-shaped end 54 is orientated downwardly within the magazine. In such a position the upper arm of the U-shaped end projects into the magazine and prevents balls from dropping into the ejector tube by partially blocking off the bottom of the magazine. Depressing the foot pedal 63 causes end 58 to be lowered thus orienting the U-shaped end upwardly, a second opposite arm of the U projects into the magazine and the first arm of the U exits the magazine. Consequently the lowermost ball initially blocked by the first arm drops and is caught by the second arm retaining the ball in the bight portion of the U-shaped end 54. Upon release, the U-shaped end is oriented downwardly again, the first arm projects into the tube blocking of the tube. The ball located in the bight portion drops into the ejector tube 42 and is ejected toward a player. The ball is played back into the net by the player, whereupon the ball drops into the gutter and rolls into the nearest depression.

The venturi effect created by air flowing through the ejector tubes 66 causes the ball to be sucked in through the downwardly opening aperture 70 into the ejector tube 66 and ejected therefrom into play.

The apparatus of the present invention can be made from available materials. Embodiments of the invention have been manufactured from standard size plastic conduit and standard electric vacuum cleaner components.

It will be recognised by persons skilled in the art that numerous variations and modifications may be made to the invention as described above without departing from the spirit or scope of the invention as broadly described.

I claim:

1. A table tennis practice device adapted to be attached to a table tennis table and to project table tennis balls across the table towards a user, the device comprising an undulating base surface a source of compressed air and at least one ejector tube which can be variably angled relative to the table, said ejector tube being substantially straight and being operatively connected at one end to the source of compressed air, said ejector tube having intermediate its ends a downwardly opening aperture in its peripheral wall, said aperture being disposed adjacent and above said undulating surface, said surface being contiguous with the table to guide table tennis balls towards the aperture, and having at least one undulating surface portion arranged so as to slope downwardly towards a point immediately below said at least one aperture in said ejector tube such that a ball rolling on said undulating surface will be sucked through said aperture and into said at least one ejection tube.

2. A device according to claim 1, wherein said source of compressed air is a motor connected to a fan for producing a positive air flow.

3. A device according to claim 1, wherein means are provided to adjust the air flow from said ejector tube.

4. A device according to claim 1, wherein position adjustment means is provided for varying the trajectory angle and direction of said ejector tube.

* * * * *